US005415265A

United States Patent [19]

Kubota

[11] Patent Number: 5,415,265

[45] Date of Patent: May 16, 1995

[54] DRIVE MECHANISM FOR AN ENDLESS TRACK CONVEYOR APPARATUS

[76] Inventor: Masao Kubota, 22-7, Narimasu 2-chome, Itabashi-ku, Tokyo, 175, Japan

[21] Appl. No.: 170,256

[22] PCT Filed: Apr. 30, 1993

[86] PCT No.: PCT/JP93/00583

§ 371 Date: Dec. 22, 1993

§ 102(e) Date: Dec. 22, 1993

[87] PCT Pub. No.: WO93/22231

PCT Pub. Date: Nov. 11, 1993

[30] Foreign Application Priority Data

May 6, 1992 [JP] Japan ..... 4-157260

[51] Int. Cl.[6] ..... B66B 21/06

[52] U.S. Cl. ..... 198/328; 198/330

[58] Field of Search ..... 198/328, 327, 330, 332, 198/333, 334

[56] References Cited

U.S. PATENT DOCUMENTS

| | | | |
|---|---|---|---|
| 888,949 | 5/1908 | Wheeler | 198/328 |
| 888,950 | 5/1908 | Wheeler | 198/328 |
| 889,080 | 5/1908 | Wheeler | 198/328 |
| 5,052,539 | 10/1991 | Fillingsness et al. | 198/328 |

FOREIGN PATENT DOCUMENTS

| | | | |
|---|---|---|---|
| 4101145 | 7/1991 | Germany | 198/328 |
| 32-9171 | 10/1957 | Japan . | |
| 46-33108 | 8/1971 | Japan . | |
| 54-144689 | 11/1979 | Japan . | |

*Primary Examiner*—D. Glenn Dayoan
*Attorney, Agent, or Firm*—Staas & Halsey

[57] ABSTRACT

An endless track conveyor apparatus having steps (1, 2) is driven by a drive chain (6) circulating along an endless travelling track (A, B–M, N, A) made up of an ascending section, a descending section, and U-turn sections connecting these ascending and descending sections. The endless track conveyor apparatus includes a driven medium having a number of piled-up slats (50), each of which is swingably supported on a conveyor frame. The driven medium engages with teeth provided on either the upper or the lower side of a chain link of the drive chain (6) provided at the ascending section (C-D) of the travelling track. The passive medium transmits the drive power of the drive chain (6) to the conveyor frame. Therefore, the endless track conveyor apparatus travels along the travelling track. On the other hand, at the descending section (J-K) of the travelling track, the load acting on the conveyor apparatus is converted into rotational motion. This rotational force is then reversed by a reversal transmission mechanism (8, 90–92, 107, 108) to transmit this rotational force to a rotational axis (105) which drives the drive chain (6).

5 Claims, 7 Drawing Sheets

DRIVE MECHANISM FOR AN ENDLESS TRACK CONVEYOR APPARATUS

TECHNICAL FIELD

The present invention relates to a drive mechanism of an endless track conveyor apparatus comprising individual treads connected integrally one another so that all the treads are kept level, more particularly to a drive mechanism preferably applied to an escalator or a moving sidewalk.

BACKGROUND ART

An escalator, in which treads are held level, and tracks for going trip and return trip are integrally constructed, is well known. Driving mechanism of such an escalator, however, fundamentally relies on a flexible chain. A disadvantage of the flexible chain resides in difficulty in putting it to practical use. The inventor of present application has already applied for a patent right to the Japanese Patent Office, regarding the invention relating to an endless track conveyor apparatus utilizing a parallel link mechanism with flexible links (the Japanese Patent Application No. HEI 1-230458/1989, which is later published as the Laid-open Japanese Patent Application No. HEI 3-95095/1991). Furthermore, the inventor of this application has applied for a patent right to the Japanese Patent Office, regarding the invention relating to an endless track conveyor apparatus utilizing flexible connecting links and auxiliary guide rails capable of keeping the treads level (the Japanese Patent Application No. HEI 1-241770/1989, which is later published as the Laid-open Japanese Patent Application No. HEI 3-106790/1991). These prior arts basically rely on a method, in which driving power is derived from "pushing" force. In this method, therefore, the connecting links and treads are required to have the rigidity of the connecting links and the treads. However, increasing the rigidity entails a disadvantage such that overall weight of the apparatus increases correspondingly. Furthermore the driving mechanism used in these prior arts employs gears or the like means; therefore, accuracy requirement to be met is too high to put the apparatus to practical use.

DISCLOSURE OF INVENTION

Accordingly, an object of the present invention is to provide a driving mechanism for an endless track conveyor apparatus capable of saving driving power with utilization of weight of a descending stairway without increasing height of steps, without accumulating loads on the treads, and without requiring high accuracy in the drive of treads.

In order to accomplish above purpose, the present invention provides a drive mechanism for an endless track conveyor apparatus comprising: a guide mechanism for guiding a conveyor frame of an endless track conveyor apparatus along an endless travelling track, the endless travelling track including an ascending section, a descending section, and horizontal straight sections and U-turn sections connecting the ascending and descending sections; a drive chain provided along said ascending section of the endless travelling track; a drive mechanism for rotating said drive chain in a predetermined direction; a driven medium comprising a plurality of piled-up hard slats, each of the slats being swingably installed on the conveyor frame and engageable with teeth provided on either of upper and lower portions of a chain link of the drive chain; the conveyor frame being transmitted a driving force from the drive chain through the driven medium so that the endless track conveyor apparatus always positions above a surface defined by the endless travelling track and circulates along said endless travelling track; and a reversal transmission mechanism for converting a load acting on a drive chain at the descending section of the endless travelling track into rotational motion, then reversing this rotational force, to transmit to the drive mechanism.

It will be preferable ill the above-identified drive mechanism that the reversal transmission mechanism is provided along the descending section of the endless travelling track, and the reversal transmission mechanism comprising: a chain having chain links provided with teeth engageable with the slats installed on the conveyor frame, a chain sprocket entraining this chain, a rotational axis of the chain sprocket, and a power transmission mechanism transmitting rotational force of the rotational axis to the drive chain.

Furthermore, the present invention provides a drive mechanism for an endless track conveyor apparatus which circulates a number of integrally connected steps on rails while maintaining their treads horizontally, comprising: a step body including a frame portion having a tread thereon, right and left bracket portions; the bracket portion including a wheel travelling on the rail, a connecting link rotatably connecting two adjacent steps, and a slat holder rotatable about a horizontal axis normal to a travelling direction and held parallel to the connecting link in the region other than U-turn sections; a chain travelling in parallel with a longitudinal direction of the slat holder; wherein the chain has right and left chain links extending in the chain travelling direction to define chain link extended portions; the chain link extended portions of the right and left chain links has inner surfaces forming teeth consisting of ridges and bottoms, the ridges and bottoms of one chain link extended portion confronting with bottoms and ridges of the other chain link extended portion, respectively; the slat holder holds a driven medium consisting of a number of piled-up hard slats swingable approximately in an axial direction of a pin of the chain, each of the hard slats being pushed by a thread of a tooth formed on one chain link extended portion and entering a bottom of the opposite tooth formed on the other chain link extended portion when passing through an inside space between said right and left chain extended portions and the chain being driven by a chain sprocket drive system having a drive axis driven in a predetermined direction and another chain sprocket drive system having another drive axis driven in a direction opposite to the drive axis.

It will be preferable in the above-defined drive mechanism that the teeth formed on the one chain link extended portion and the teeth formed on the other chain link extended portion are respectively formed to have equal pitch, tooth trace of these teeth is normal to the travelling direction of the chain, the tooth trace of one chain link extended portion and the tooth trace of the other chain link extended portion forms an acute angle therebetween in such a manner that a distance between these tooth traces increases as it goes to remote ends; the hard slats supported on the slat holder are swingable about a slat spindle provided on a boss of the slat holder within a limited angle, each of the hard slat has a head formed in a shape corresponding to the acute angle formed between tile tooth trace of one chain link extended portion and the opposing tooth trace of the other chain link extended portion; and the teeth of the chain transmits driving force through said hard slats to the slat spindle and the slat holder boss supporting the slat spindle, thereby transmitting the driving force to the endless track conveyor apparatus.

It will be further preferable in the above-defined drive mechanism that each of said right and left bracket portions includes a support portion supporting the frame portion and an upper extended portion supporting the connecting link, the support portion and the upper extended portion being spaced by a groove into which a skirt guard panel is inserted, whereby the drive chain is disposed outside the skirt guard panel and concealed below a moving handrail.

In accordance with the present invention, it becomes possible to install an endless track conveyor apparatus such as an escalator and a moving sidewalk cheaply by applying relatively simple modification on an existing stairs without increasing height of steps and requiring high accuracy in the drive mechanism.

BEST MODE FOR CARRYING OUT THE INVENTION

An escalator, shown in the following description as one example of an endless track conveyor apparatus, includes a going by ascending track and a returning by descending track, which are disposed in parallel and connected with each other. This escalator includes, as main components, a parallel link mechanism using connecting links foldable at the center, a mechanism for keeping the treads level by the use of a free rotation disk provided at U-turn track sections, and a roller chain. Furthermore, the drive mechanism of this escalator includes hard slats by which weight of the descending travelling track is utilized for saving driving power.

Figure 1:
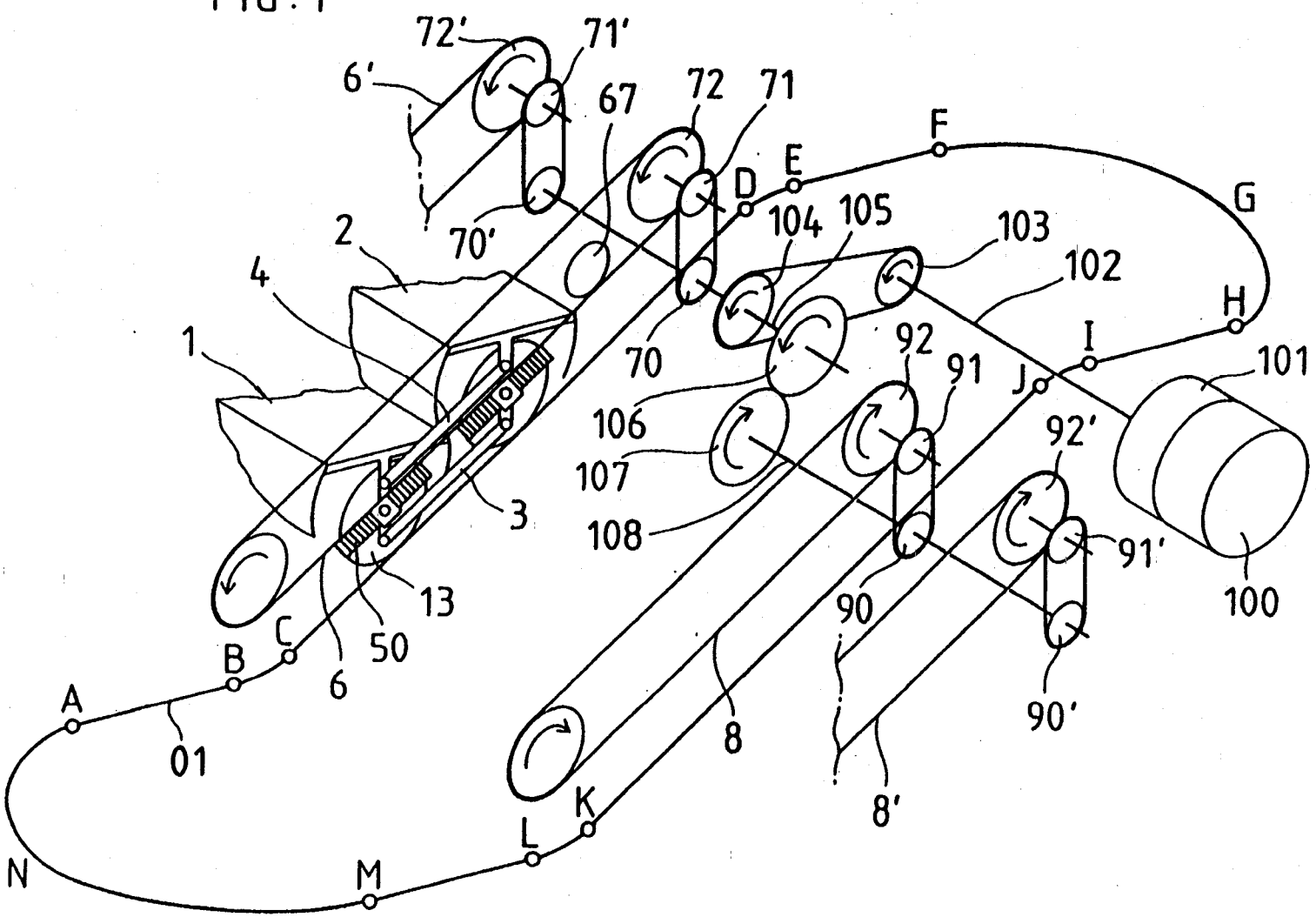
FIG. 1 is a schematic view showing a drive mechanism of an escalator in accordance with one embodiment of the present invention.

In FIG. 1, a circulating endless track A, B, C,–, L, M, N, and A shows an inner rail of the travelling track of the escalator. A portion A-B is referred to as a downstairs first straight travelling section, and a portion B-C is referred to as a shift-to-upward travelling section, a portion C-D is referred to as an inclined straight ascending section, a portion D-E is referred to as an upstairs shift-to-horizontally straight travelling section, a portion K-L is referred to as an upstairs first straight travelling section, a portion F-G-H is referred to as an upstairs horizontal U-turn section, a portion H-I is referred to as an upstairs second straight travelling section, a portion I-J is referred to as a shift-to-downward travelling section, a portion J-K is referred to as an inclined straight descending section, a portion K-L is referred to as a downstairs shift-to-horizontally straight travelling section, and a portion L-M is referred to as a downstairs second straight travelling section, and a portion M-N-A is referred to as a downstairs horizontal U-turn section.

Figure 3:
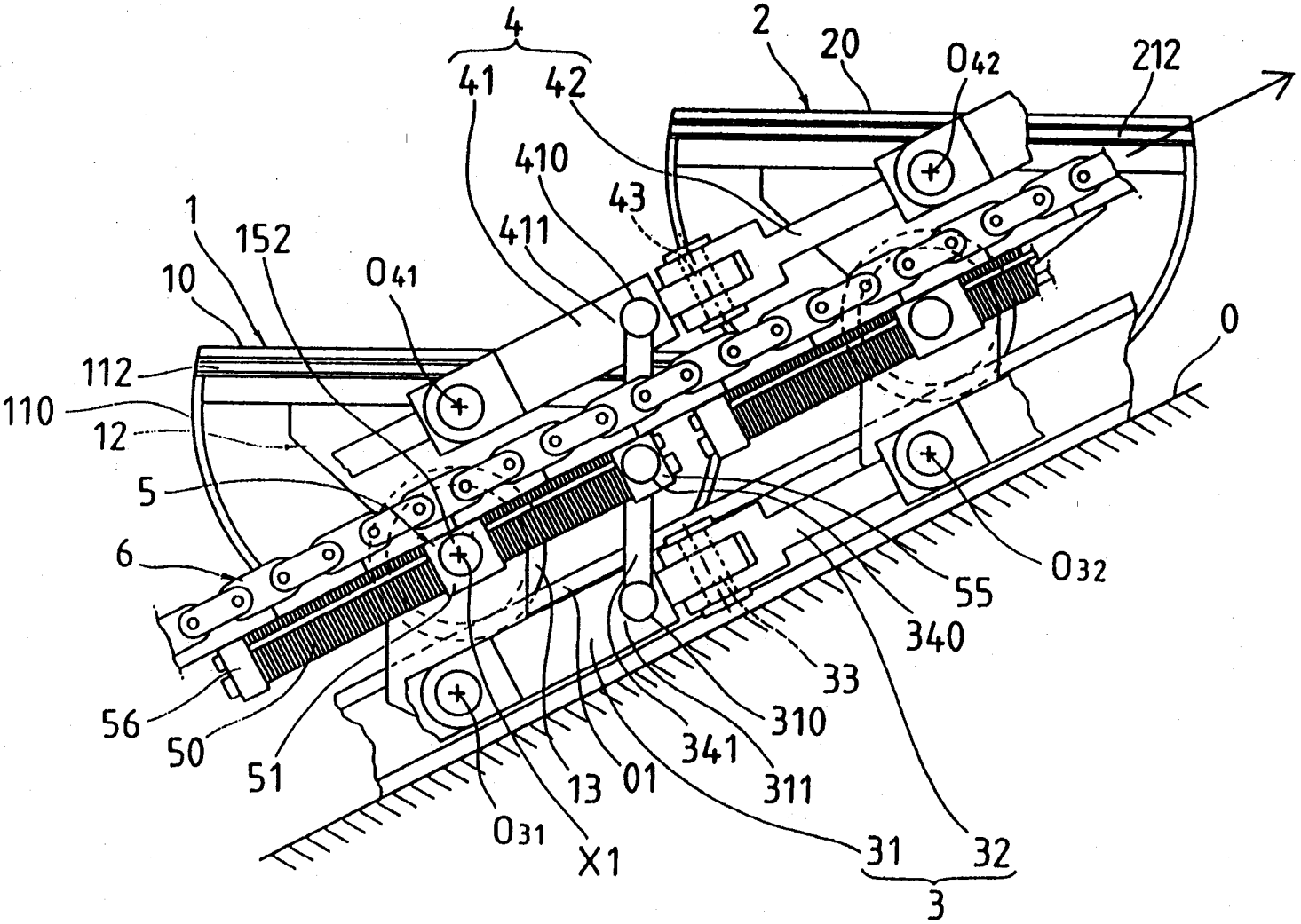
FIG. 3 is a side view schematically showing a drive mechanism of an inner stairway at an inclined and straight ascending sections of the above escalator drive mechanism.

FIG. 3 is a side view schematically showing a drive mechanism for driving treads of the inner stairway of the escalator in a straight ascending section C-D. Any adjacent two steps 1 and 2 are connected with each other by means of a parallel 1 link mechanism which ties the pin connecting points $O_{31}$, $O_{41}$; and $O_{32}$, $O_{42}$ disposed on perpendiculars passing through the centers of their treads 10 anti 20, respectively. More specifically, there is provided a connecting link 3 for the pin connecting points $O_{31}$ and $O_{32}$ of the steps 1 and 2. Similarly, there is provided a connecting link 4 for the pin connecting points $O_{41}$ and $O_{42}$ of the steps 1 and 2. The connecting link 3 consists of a pair of half links 31 and 32 connected with each other at the center rotatably about a pin 33, and the connecting link 4 consists of a pair of half links 41 and 42 connected with each other at the center rotatably about a pin 43. Accordingly, these connecting links 3 and 4 are foldable at the U-turn sections F-G-H and M-N-A of the travelling track about the pins 33 and 34 whose axes extend in the up-and-down direction.

The steps 1 and 2 have V-shaped grooves 112 and 212 respectively extending horizontally along the inner side thereof. These V-shaped grooves 112 and 212 mesh with peripheral edges of disks 03 and 04 disposed rotatably around vertical axes 031 and 041 at the upstairs and downstairs U-turn sections (i.e. portions F-G-H and M-N-A in FIG. 1), respectively, as shown in a plane view of FIG. 8. This arrangement ensures the treads 10 and 20 to stabilize the position horizontally at the U-turn sections.

Figure 2:
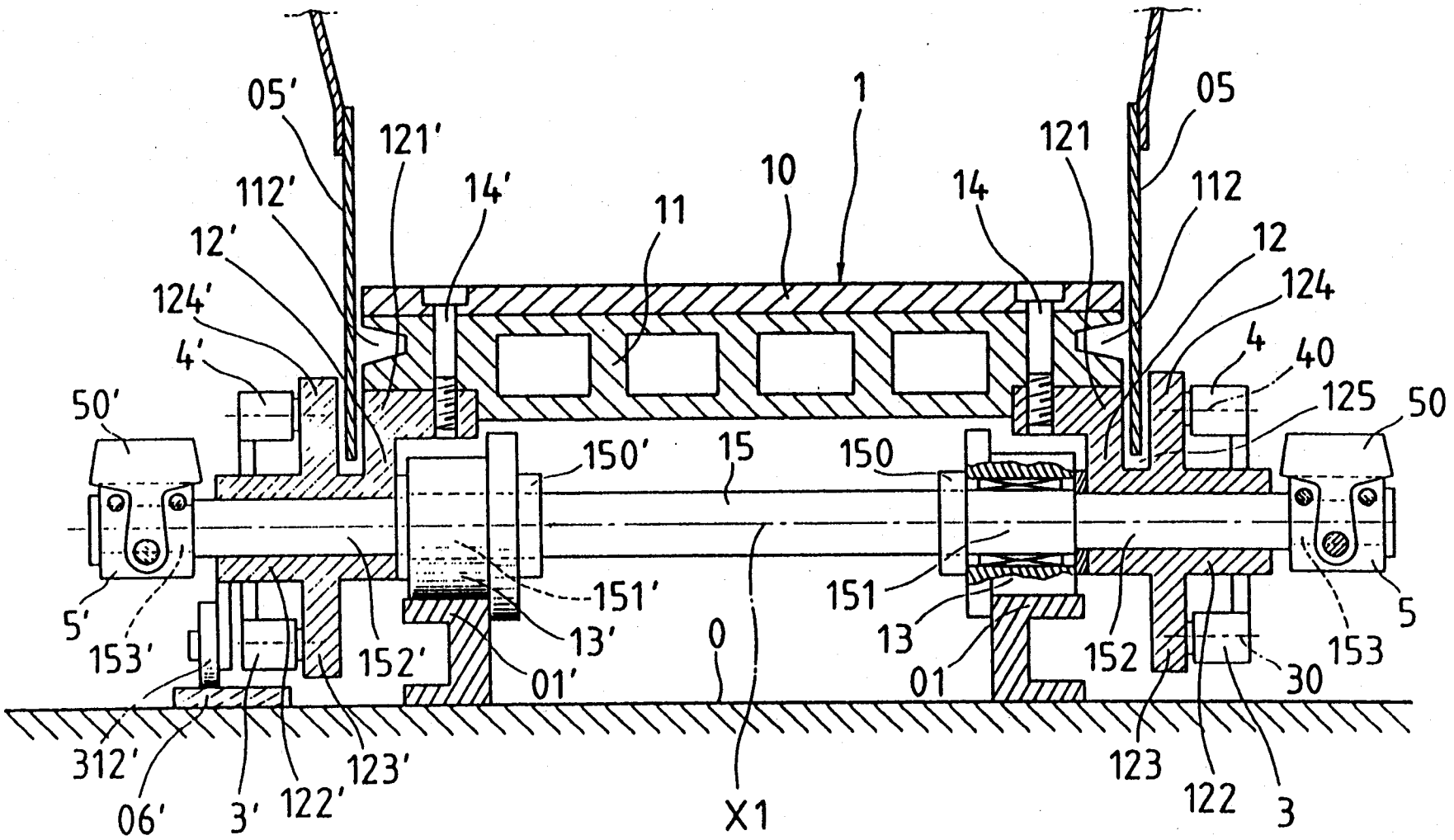
FIG. 2 is a sectional front view showing a horizontal straight travelling section of the above escalator drive mechanism.

Hereinafter, body structure of the step will be explained in detail. As shown in FIG. 2, the step 1 basically consists of three main components of a frame portion 11 having a tread 10 on the upper surface thereof, a right bracket portion 12, and a left bracket portion 12'. These components are manufactured separately. In assembling these components as shown in FIG. 2, the right and left bracket portions 12 and 12' are connected first of all through the spindle 15. Then, the frame portion 11 is fixed on these right and left bracket portions 12 and 12' by means of bolts 14, 14'. In this case the right and left bracket portions 12 and 12' are symmetrical and identical in size; therefore, they are suitable to mass production. It is, however, possible to form an integral structure of the above three components.

A wheel 13 and a slat holder 5 are provided at the lower part of the bracket portion 12 and rotatably coupled with the extended portion of the spindle 15 in such a manner that the axes of these wheel 13 and the slat, holder 5 coincide with the axis X1 of the spindle 15. The slat holder 5 is always held in parallel with the lower half link 31 since it is connected with the parallel link mechanism previously described.

A roller chain 6 travels above and in parallel with the slat holder 5. As described later, the roller chain 6 has right and left link plates having teeth thereon. Hard slats 50 accommodated in the slat holder 5 mesh with these teeth.

Figure 5:
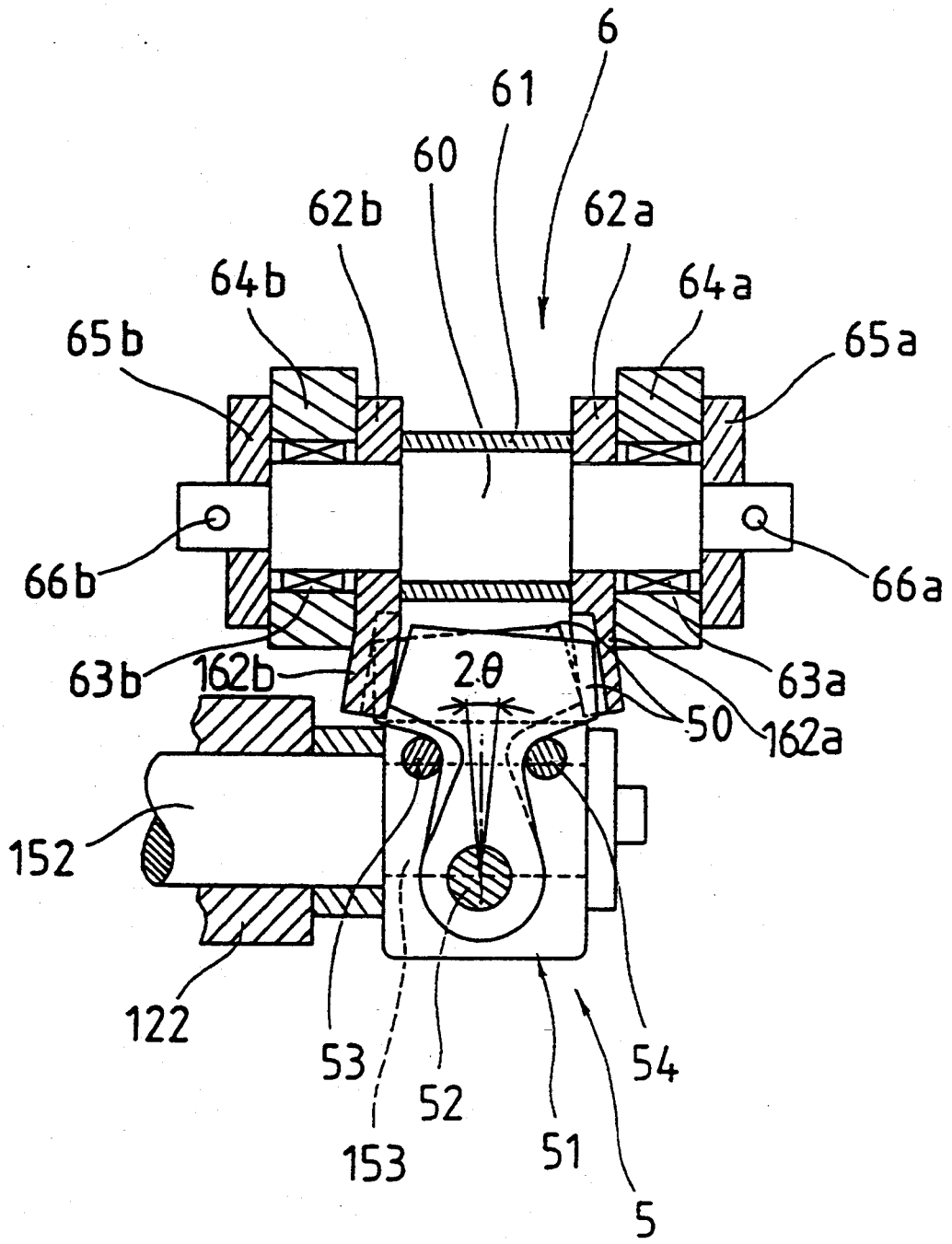
FIG. 5 is a partly sectional view illustrating a transmission mechanism by which driving force of the chain is transmitted to a spindle of the escalator through hard slats.
Figure 6:
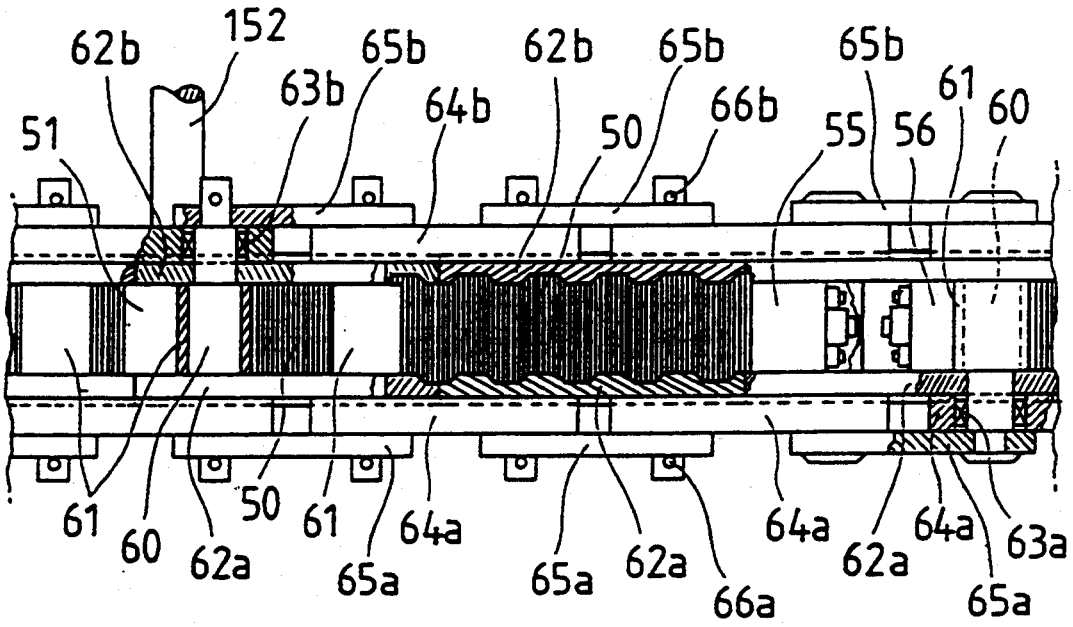
FIG. 6 is a plane view illustrating meshing engagement between the chain and the hard slats in the above escalator drive mechanism.
Figure 7:
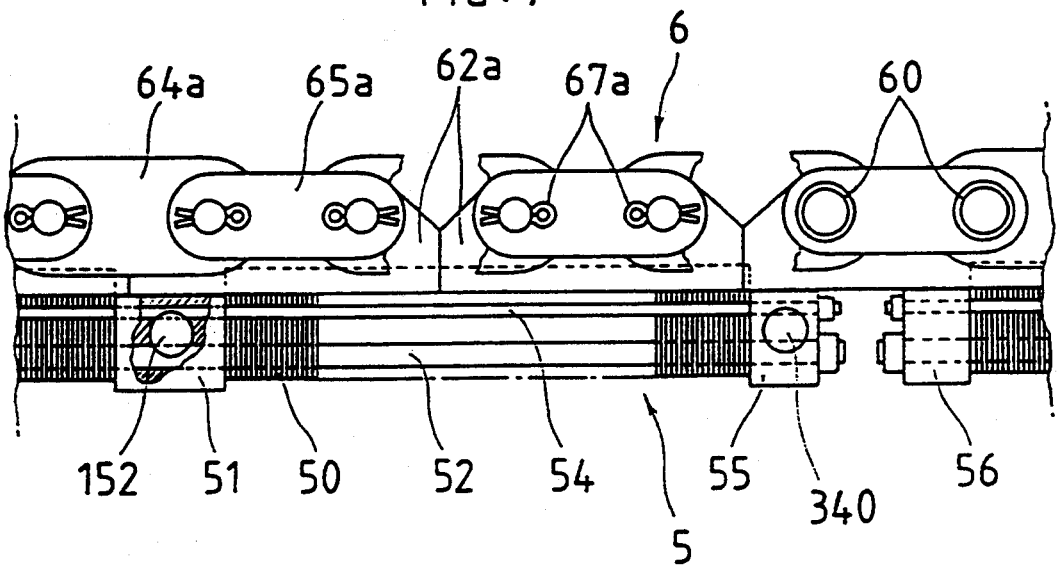
FIG. 7 is a side view illustrating the above meshing engagement.

The chain 6 used in this embodiment is characterized in that no bush is used and a needle-type roller bearing is provided between a pin and a link. As shown in FIG. 5 to FIG. 7, a pin 60 has a central portion to be coupled with a roller 61 and first and second stepped portions extending successively from the central portion toward remote end in both the right and left directions. Adjacent two (first and second) pins 60 and 60, disposed in parallel with each other, are connected by means of a pair of first connecting chain links **62*a* and 62*b* which couple with approximately inner ⅓ of the right and left first stepped portions. However, another adjacent two (second and third) pins 60 and 60, disposed in parallel with each other, are not connected by means of the first connecting chain links 62*a* and 62*b*. Instead, these second and third pins 60 and 60 are foldably connected with each other by means of a pair of movable links 64*a* and 64*b* which couple with the remaining ⅔ of the right and left first stepped portions through the needle-type rollers 63*a* and 63*b***.

The above two adjacent pins 60, 60 connected by the first connecting chain links **62*a* and 62*b* are further connected by a pair off second connecting chain link 65*a* and 65*b* coupled at the second stepped portions. The second stepped portions have holes 66*a* and 66*b* for receiving cotter pins 67*a* and 67*b* by which the second connecting chain links 65*a* and 65*b* are prevented from falling off the pin 60**.

Furthermore, the above first connecting chain links **62*a* and 62*b* have lower extended portions 162*a* and 162*b* integrally formed so as to extend in the chain travelling direction by a length twice as long as the chain pitch. As shown in FIG. 6, these extended portions 162*a* and 162*b* of the first connecting chain links 62*a* and 62*b* contact with adjacent extended portions 162*a* and 162*b* of another first connecting chain links 62*a* and 62*b* since these extended portions 162*a* and 162*b*** have length twice as long as the chain pitch in the chain travelling direction.

The extended portions **162*a* and 162*b* of the first connecting chain links 62*a* and 62*b* confront with each other in such a manner that a distance between extended portions 162*a* and 162*b* increases gradually as it goes downward (toward the axis of the spindle 15) as shown in FIG. 5. These extended portions 162*a* and 162*b* have inside surfaces which are formed with low teeth, each tooth trace extending in a direction normal to the chain travelling direction. The teeth of the extended portion 162*a* and the teeth of the extended portion 162*b* are formed in a manner such that a toothtrace in the portion 162*a* and a tooth trace in the portion 162*b* intersect with each other by approximately 20 degrees or less and further a tooth ridge in the portion 162*a* and a tooth bottom in the portion 162*b* are opposed each other. By the way, as shown in FIG. 6, the extended portion 162*a* of the first connecting chain link 62*a* is identical with the extended portion 162*b* in the second connecting chain link 62*b* in configuration of the teeth. The first connecting chain link 62*a* can be used, if reversed, as the second connecting chain link 62*b*, the ridges of the teeth of one extended portion accurately confronting with the bottoms of the opposite teeth of the other extended portion. Furthermore, instead of using cotter pins 67*a* and 67*b*, caulking the ends of the spindle 15 as shown in FIGS. 6 and 7** would be effective for preventing the link from falling off.

Hard slats 50 mesh with the teeth formed on the extended portions **162*a* of the first connecting chain link 62*b* and the opposite extended portion 162*b* of the second connecting chain link 62*b*. There are provided a number of piled-up hard slats 50 having the same configuration (substantially T shape coexisting of a stem portion and a head portion as shown in FIG. 5). Each of the hard slats 50 has a hole opened at a base end thereof. A slat spindle 52, fixed to the boss 51 of the slat holder 5, passes through the hole of each hard slat 50. When one side of the head portion of a sheet of hard slat is pushed by the ridge of the extended portion 162*a* of the first connecting chain link 62*a* toward the extended portion 162*b* of an opposing second connecting chain link 62*b*, the other side of the head portion of the same hard slat comes into the bottom of the tooth in the extended portion 162*b*. With such a swing motion of individual slat, the combination of hard slats 50 constitutes teeth which are capable of changing in their general shape. Thus, the hard slats 50 can mesh with the teeth of the opposing extended portions 162*a* and 162*b* precisely. The boss 51 of the slat holder 5 has a pair of stopper bars 53 and 54 provided thereon as shown in FIG. 5. These stopper bars 53 and 54 restrict the swing angle of each slat 50 within 20 in the right to left direction. Driving force, transmitted from the chain 6 to the slats 50, is received by end plates 55, 56 fixed to the both ends of the slat spindle 52 and the boss 51 (Refer to FIG. 7). A chain sprocket may be used for pushing the chain 6 against the hard slats 50 in order to prevent the chain 6 from floating and ensure the meshing engagement between the slats 50 and the chain 6. Furthermore, the hard slats 50** of swing type as described above can be replaced by the one of reciprocating linear motion type.

Individual construction of the step 1, the connecting links 3 and 4, the slat holder 5, the chain 6, and the wheel 13 should be determined by taking a floor 0 and side walls into consideration. One example thereof is shown in FIG. 2. A body of a step 1 includes a frame portion 11 equipped with a tread 10 and a riser 110 (FIG. 3), a bracket portion 12 at the inner rail side equipped with the connecting links 3, 4, the slat holder 5, and the wheel 13, and a bracket portion 12' at the outer rail side equipped with the connecting links 3', 4', the slat holder 5', and the wheel 13'. These three components are connected by means of the bolts 14 and 14'. By the way, as components at the inner rail side and components at the outer rail side resemble each other, each of the components at the outer rail side is given the same reference numeral as the corresponding component at the inner rail side, for the following explanation, but "'" is added at the end of such numeral. The bracket portion 12 of the step 1, as shown in FIG. 2, consists of a support portion 121 supporting the frame portion 11, a bearing portion 122 supporting an extended portion 152 of an axle 151, a lower extended portion 123 supporting the connecting link 3, and an upper extended portion 124 supporting the connecting link 4.

The axle 151 and its extended portion 152 are coaxial with the spindle 15 as well as an axle 151' at the outer rail side and its extended portion 152'; therefore, these members have a common axis X1 extending horizontally. This horizontal axis X1 is located at a position equally spaced from an axis 30 of the connecting link 3 and an axis 40 of the connecting link 4.

A groove portion 125 is formed between the support portion 121 supporting the frame portion 11 and the upper extended portion 124 supporting the connecting link 4. A skirt guard panel 05 is inserted in this groove portion 125. Therefore the driving chain 6 is positioned outside this skirt panel 05. Namely, the driving chain 6 is disposed in a space below a moving handrail (not shown).

The spindle 15 has a pair of flanges 150 and 150' at right and left portions thereof for positioning of the wheels 13 and 13'. The extended axles 152 and 152' are further extended at remote ends thereof for forming end axles 153 and 153', on which the bosses 51 and 51' of the slat holders 5 and 5' are fixed (FIGS. 3 and 5).

As apparent from the sectional view of FIG. 5, the slat spindle 52 and stopper bars 53, 54 pass through the boss 51 of the slat holder. These slat spindle 52 and stopper bars 53, 54 pierce the boss 51 of the slat holder and have cutouts formed at the centers of their longitudinal directions so as to get astride the end axle 153.

As shown in FIG. 3, the half links 311 and 411 are rotatably connected with a vertical link 341 through pins 310 and 410, respectively. Furthermore this vertical link 341 is rotatably connected, at its center, with the end plate 55 of the slat holder by means of a pin 340. Thus the half link 31 and the vertical link 341 cooperatively constitute a parallel link mechanism, which always maintains the slat holder 5 parallel to the half link 31.

Figure 4:
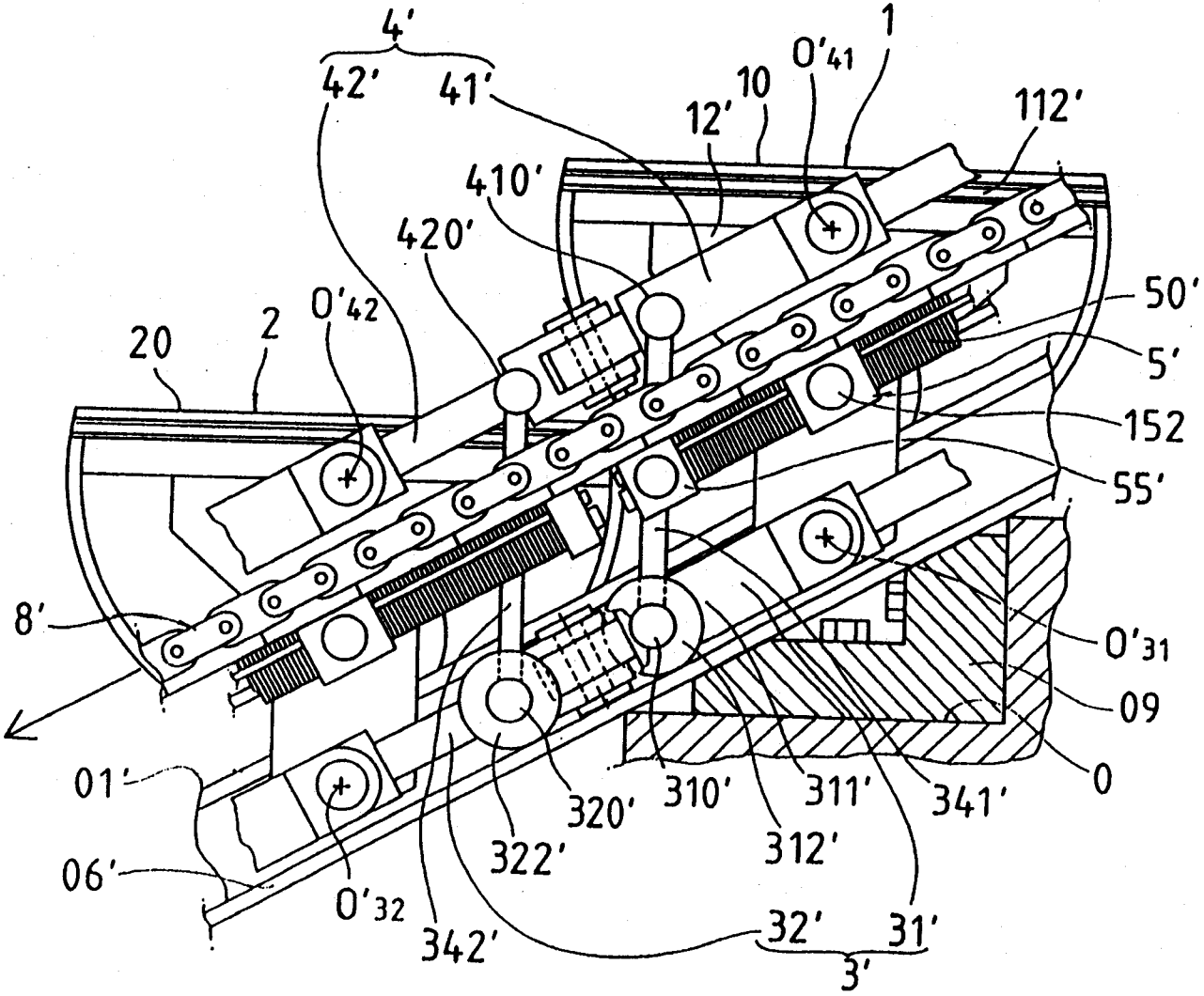
FIG. 4 is a side view schematically showing a drive mechanism of an outer stairway at an inclined straight descending sections of the above escalator drive mechanism, seen from the outboard side thereof.

As described previously, each of the components at the outer rail is side given the same reference numeral as the corresponding component at the inner rail side although "'" is added at the end of the numeral because the components at the inner rail side and the components at the outer rail side have good correspondence. However, at the horizontal U-turn sections F-G-H and M-N-A of the travelling track the connecting links 3' and 4' at the outer rail side are differentiated a little bit from the connecting links 3 and 4 at the inner rail side in their structures. More specifically, the half links 31' and 32' of the connecting link 3' and the half links 41' and 42' of the connecting link 4' are constituted to be separable. In order that the half links 31', 41' and the slat holder 5' may be maintained parallel to the half links 31, 41 at the inner rail side and the slat holder 5, the half link ends 311' and 411' are rotatably connected with each other via a vertical link 341' and pins 310', 410' as shown in FIG. 4. And, the center of this vertical link 341' is rotatably connected to the end plate 55' of the slat holder 5' through a pin 340'. Furthermore, an auxiliary wheel 312' coaxial with the pin 310' is guided by an auxiliary rail 06' which is parallel to the outer rail 01'.

On the other hand, the remaining half links 32' and 42' of the connecting links 3' and 4' at the outer rail side are totally connected with each other via a vertical link 342' and pins 320', 420' in the same manner as in the case of the half links 31' and 41'. However, the slat holder 5' is not connected with this vertical link 342'. The pin 320' is attached with a coaxial auxiliary wheel 322' which is guided by an auxiliary rail 06', in the same manner as in the case of the pin 310'

Figure 8:
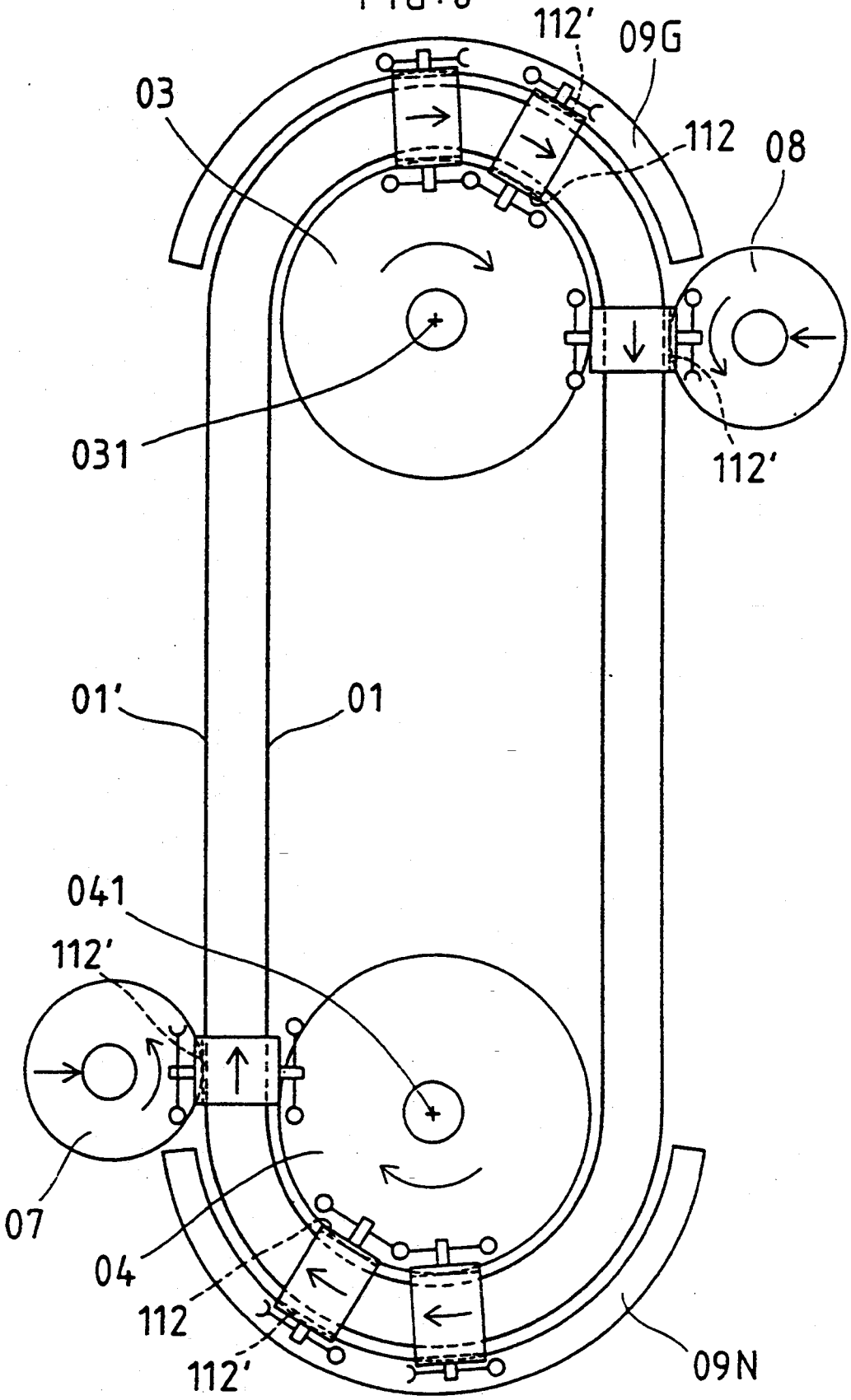
FIG. 8 is a plane view schematically showing an accelerating mechanism for accelerating an outer peripheral end of each tread and a disk mechanism for the U-turn section provided in the above escalator drive mechanism.

As shown in FIG. 8, frictional wheels 07 and 08 are respectively provided outside the connecting points of the U-turn sections and the straight sections, so that the step 2 is securely connected at the outer rail side after transferring from the U-turn section to the straight section of the travelling track. The frictional wheels 07 and 08 enter a V-shaped groove 112' (FIG. 2) provided on the outside edge of the frame portion 11. The rotational speed of these frictional wheels 07 and 08 are set slightly faster than the travelling speed of the step 2. This speed difference causes frictional force which accelerates the step 2 and, therefore, the half links 31' and 32' and the half links 41' and 42' are engaged firmly. By the way, in order to increase stability of the step at the U-turn section of the travelling track, there may be provided plates 09G and 09N outside and in parallel with the U-turn sections of the outboard rail 01' so that these plates 09G and 09N enter the V-shaped groove 112'.

A mechanism shown in FIG. 1 is suitable for driving the chain 6 which drives the steps. Namely, a motor 100 drives an axis 102 via a speed reduction device 101. A chain sprocket 103 provided on the axis 102, transmits driving force to a chain sprocket 104 via a chain. An axis 105, provided coaxially with the chain sprocket 104, is thus driven. A chain sprocket 70 on the axis 105 drives a chain sprocket 711 which is coaxial with a chain sprocket 72' or driving the chain 6. In the same manner, at the outer rail side, a chain sprocket 70' on the axis 105 drives a chain sprocket 71' coaxial with a chain sprocket 72' for driving the chain 6'. Next, in the descending section at the inner rail side, the chain 8 is given tension by the weight of a stairway and passengers and therefore a chain sprocket 92 is rotated. Such rotation of the chain sprocket 92 is transmitted to a chain sprocket 90 coaxial with the chain sprocket 92. A gear 107, provided on an axis 108 of the chain sprocket 90, transmits rotation to a gear 106 on the axis 105 which has same number of tooth as that of the gear 107. Similarly, at the outer rail side, rotational force is transmitted via a path passing through the chain 8'→the chain sprockets 92'→91'→90'→the axis 108. Accordingly, the weight of the descending stairway contributes to the saving of drive power.

In this manner a rotational direction of the drive axis 108, provided in the descending stairway, is reversed by two external gears 106 and 108 meshing with each other. Then, the rotational force is transmitted to the drive axis 105. Thus, the weight of the descending stairway can be converted into the drive force of the ascending stairway.

As described in the foregoing description, in accordance with the drive mechanism for the conveyor apparatus of the present invention, it becomes possible to save the drive power with utilization of weight of the descending stairway without accumulating loads on the treads and without requiring high accuracy in the drive of individual treads. Furthermore, increase of the height of the steps can be adequately suppressed. Moreover, as a means for transmitting driving force of the chain to the steps, the present invention utilizes a driven medium comprising a number of plied-up slats (hard slats) capable of swinging in the direction normal to the chain travelling direction. Thus, no phase adjustment is necessary and high accuracy is not required.

By the way, in the case where the escalator in accordance with the present invention is installed on an existing stairs, a sleeper or cross tie 09 will be fixed on the stairs and then the rails 01 and 01' will be fixed thereon as shown in FIG. 4.

This invention can be applied to a moving sidewalk in the same manner. Compared with the conventional one, it becomes possible to install the moving sidewalk by digging a shallow groove. Going and returning travelling tracks can be assembled as one set. The track conveyor according to this invention would function as an escalator when applied to a rugged path, thus ensuring simple installation.

We claim:

1. A drive mechanism for an endless track conveyor apparatus comprising:

a guide mechanism for guiding a conveyor frame of an endless track conveyor apparatus along an endless travelling track, said endless travelling track including an ascending section, a descending section, and horizontal straight sections and U-turn sections connecting said ascending and descending sections;

a drive chain provided along said ascending section of the endless travelling rack;

a drive mechanism for rotating said drive chain in a predetermined direction:

a driver medium comprising a plurality of piled-up slats, each of said slats being swingably installed on said conveyor frame and engageable with teeth provided on either of upper and lower portions of a chain link of said drive chain, said conveyor frame being transmitted a driving force from said drive chain through said driven medium so that the endless track conveyor apparatus always positions above a surface defined by said endless travelling track and circulates along said endless travelling track; and a reversal transmission mechanism fop converting a lead acting on a drive chain at said descending section of said endless travelling track into rotational motion, then reversing this rotational force to transmit to said drive mechanism.

2. A drive mechanism for an endless track conveyor apparatus according to claim 1, wherein said reversal transmission mechanism is provided along said descending section of said endless travelling track, and said reversal transmission mechanism comprising:

a chain having chain links provided with teeth engageable with the slats installed on said conveyor frame, a chain sprocket entraining this chain, a rotational axis of said chain sprocket, and a power transmission mechanism transmitting rotational force of said rotational axis to said drive chain.

3. A drive mechanism for an endless track conveyor apparatus which circulates a number of integrally connected steps on rails while maintaining their treads horizontal, comprising:

a step body including a frame portion having a tread thereon, right and left bracket portions, said bracket portion including a wheel travelling on the rail, a connecting link rotatably connecting two adjacent steps, and a slat holder rotatable about a horizontal axis normal to a travelling direction and held parallel to said connecting link in the region other than U-turn sections;

a chain travelling in parallel with a longitudinal direction of said slat holder;

wherein said chain has right and left chain links extending in the chain travelling direction to define chain link extended portions;

said chain link extended portions of the right and left chain links has inner surfaces forming teeth consisting of ridges and bottoms, said ridges and bottoms of one chain link extended portion confronting with bottoms and ridges of the other chain link extended portion respectively;

said slat holder holds a driven medium consisting of a number of piled-up hard slats approximately swingable in an axial direction of a pin of said chain, each of said hard slats being pushed by a ridge of a tooth formed on one chain link extended portion and entering a bottom of the opposite tooth formed on the other chain link extended portion when passing through an inside space between said right and left chain extended portions; and said chain is driven by a chain sprocket drive system having a drive axis driven in a predetermined direction and another chain sprocket drive system having another drive axis driven in a direction opposite to said drive axis.

4. A drive mechanism for an endless track conveyor apparatus according to claim 3, wherein said teeth formed on said one chain link extended portion and said teeth formed on said the other chain link extended portion are respectively formed to have equal pitch, tooth trace of these teeth is normal to the travelling direction of the chain, the tooth trace of said one chain link extended portion and the tooth trace of said the other chain link extended portion forms an acute angle therebetween in such a manner that a distance between these tooth traces increases as it goes to remote ends;

said hard slats supported on the slat holder are swingable about a slat spindle provided on a boss of the slat holder within a limited angle, each of said hard slats has a head formed in a shape corresponding to said acute angle formed between the tooth trace of one chain link extended portion and the opposing tooth trace of the other chain link extended portion; and the teeth of said chain transmits driving force through said hard slats to said slat spindle and said slat holder boss supporting said slat spindle, thereby transmitting the driving force to the endless track conveyor apparatus.

5. A drive mechanism for an endless track conveyor apparatus according to claim 3, wherein each of said right and left bracket portions includes a support portion supporting said frame portion and an upper extended portion supporting said connecting link, said support portion and said upper extended portion being spaced by a groove into which a skirt guard panel is inserted, whereby the drive chain is disposed outside said skirt guard panel and concealed below a moving handrail.

* * * * *

UNITED STATES PATENT AND TRADEMARK OFFICE

CERTIFICATE OF CORRECTION

PATENT NO. : 5,415,265

DATED : May 16, 1995

INVENTOR(S) : Kubota

It is certified that error appears in the above-indentified patent and that said Letters Patent is hereby corrected as shown below:

Column 4, line 9, change "K-L" to --E-F--

Column 4, line 24, delete "1"

Column 4, line 27, change "anti" to --and--

Column 7, line 42, insert --,-- after "track"

Column 8, line 25, change "711" to --71--

Signed and Sealed this

Twenty-fourth Day of October, 1995

*Attest:*

Bruce Lehman

BRUCE LEHMAN

*Attesting Officer*

*Commissioner of Patents and Trademarks*